US011639482B2

(12) United States Patent
Chung et al.

(10) Patent No.: US 11,639,482 B2
(45) **Date of Patent: *May 2, 2023**

(54) LUBRICANT COMPOSITIONS, AND SYNTHESIZING METHODS AND APPLICATIONS OF SAME

(71) Applicant: NORTHWESTERN UNIVERSITY, Evanston, IL (US)

(72) Inventors: Yip-Wah Chung, Wilmette, IL (US); Qian Jane Wang, Mount Prospect, IL (US); Qiang Ma, Evanston, IL (US); Arman Mohammad Khan, Evanston, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 32 days.

This patent is subject to a terminal disclaimer.

(21) Appl. No.: 17/228,920

(22) Filed: Apr. 13, 2021

(65) Prior Publication Data

US 2021/0317381 A1 Oct. 14, 2021

Related U.S. Application Data

(60) Provisional application No. 63/009,570, filed on Apr. 14, 2020.

(51) Int. Cl.
*C10M 177/00* (2006.01)
*C10M 129/34* (2006.01)
(Continued)

(52) U.S. Cl.
CPC ..... *C10M 177/00* (2013.01); *C10M 129/32* (2013.01); *C10M 129/34* (2013.01);
(Continued)

(58) Field of Classification Search
CPC ..... C10M 129/30; C10M 145/18; C10M 129/34; C10M 177/00; C10M 129/32;
(Continued)

(56) References Cited

U.S. PATENT DOCUMENTS 7,635,669 B2 * 12/2009 Culley ..... C10M 129/36 508/519
2017/0306258 A1 * 10/2017 Wang ..... C10M 133/06

OTHER PUBLICATIONS

Holmberg, K., Erdemir, A.: The impact of tribology on energy use and CO2 emission globally and in combustion engine and electric cars. Tribology International 135:389-396 (2019).
(Continued)

*Primary Examiner* — Vishal V Vasisth
(74) *Attorney, Agent, or Firm* — Locke Lord LLP; Tim Tingkang Xia, Esq.

(57) ABSTRACT

A lubricant composition includes a base lubricant and a plurality of lubricant additive molecules functioning as precursor molecules to induce tribopolymerization and forming in situ protective tribofilm with desirable robustness and low shear resistance. Each lubricant additive molecule includes one or more surface-active groups attractable to target surface, and a carbon containing component operable connected to the one or more surface active groups. The carbon containing component comprise a carbon ring structure having a high ring strain that is metastable and activatable with a ring-opening reaction. A less stable carbon ring structure is more readily activated to the intermediate state, preferable to form more active fragments. Increasing the adsorption strength further is beneficial to prolonging the residence time of additive molecules on the target surface, thereby facilitating the dissociation of molecules and subsequent polymerization.

16 Claims, 13 Drawing Sheets

(51) Int. Cl.
*C10M 129/32* (2006.01)
*C10N 70/00* (2006.01)

(52) U.S. Cl.
CPC ..... *C10M 2207/122* (2013.01); *C10M 2207/123* (2013.01); *C10N 2070/00* (2013.01)

(58) Field of Classification Search
CPC .... C10M 2207/122; C10M 2207/2835; C10M 2207/123; C10M 2209/02; C10M 2207/1225; C10N 2030/56; C10N 2030/64; C10N 2070/00
See application file for complete search history.

(56) References Cited

OTHER PUBLICATIONS

Nosonovsky, M., Bhushan, B.: Green tribology: principles, research areas and challenges. Philos Trans A Math Phys Eng Sci 368:4677-4694 (2010).
Spikes, H.: Friction modifier additives. Tribology Letters 60 (2015).
Zhou, Y., Qu, J.: Ionic liquids as lubricant additives: a review. ACS Appl Mater Interfaces 9:3209-3222 (2017).
Hermance, H.W., Egan, T.F.: Organic deposits on precious metal contacts. The Bell System Technical Journal 37:739-776 (1958).
Fein, R.S., Kreuz, K.L.: Chemistry of boundary lubrication of steel by hydrocarbons. A S L E Transactions 8:29-38 (1965).
Furey, M.J., Kajdas, C., Ward, T.C., Hellgeth, J.W.: Thermal and catalytic effects on tribopolymerization as a new boundary lubrication mechanism. Wear 136:85-97 (1990).
Zheng, J., Zhang, L., Du, Z., Zhang, C., Li, H.: Tribopolymerization of n-butyl acrylate on the steel-steel rubbing surface. Tribology International 41:769-777 (2008).
Svahn, F., Csillag, S.: Formation of low-friction particle/polymer composite tribofilms by tribopolymerization. Tribology Letters 41:387-393 (2010).
Wang, Q.J., Chung, Y.-W.: Encyclopedia of Tribology (2013).
Khajeh, A., He, X., Yeon, J., Kim, S.H., Martini, A.: Mechanochemical association reaction of interfacial molecules driven by shear. Langmuir 34:5971-5977 (2018).
He, X., Kim, S.H.: Surface chemistry dependence of mechanochemical reaction of adsorbed molecules—an experimental study on tribopolymerization of alpha-pinene on metal, metal oxide, and carbon surfaces. Langmuir 34:2432-2440 (2018).
Yeon, J., He, X., Martini, A., Kim, S.H.: Mechanochemistry at solid surfaces: polymerization of adsorbed molecules by mechanical shear at tribological interfaces. ACS Appl Mater Interfaces 9:3142-3148 (2017).
Wu, H., Khan, A.M., Johnson, B., Sasikumar, K., Chung, Y.W., Wang, Q.J.: Formation and nature of carbon-containing tribofilms. ACS Appl Mater Interfaces 11:16139-16146 (2019).
Johnson, B., Wu, H., Desanker, M., Pickens, D., Chung, Y.-W., Jane Wang, Q.: Direct formation of lubricious and wear-protective carbon films from phosphorus- and sulfur-free oil-soluble additives. Tribology Letters 66 (2017).
Gosvami, N.N., Bares, J.A., Mangolini, F., Konicek, A.R., Yablon, D.G., Carpick, R.W.: Mechanisms of antiwear tribofilm growth revealed in situ by single-asperity sliding contacts. Science 348:102 (2015).
Adams, H., Miller, B.P., Furlong, O.J., Fantauzzi, M., Navarra, G., Rossi, A., Xu, Y., Kotvis, P. V., Tysoe, W. T.: Modeling mechanochemical reaction mechanisms. ACS Appl Mater Interfaces 9:26531-26538 (2017).
Jacobs, T.D.B., Gotsmann, B., Lantz, M.A., Carpick, R.W.: On the application of transition state theory to atomic-scale wear. Tribology Letters 39:257-271 (2010).
Jacobs, T.D., Carpick, R.W.: Nanoscale wear as a stress-assisted chemical reaction. Nat Nanotechnol 8:108-112 (2013).
Spikes, H., Tysoe, W.: On the commonality between theoretical models for fluid and solid friction, wear and tribochemistry. Tribology Letters 59 (2015).
Adams, H.L., Garvey, M.T., Ramasamy, U.S., Ye, Z., Martini, A., Tysoe, W.T.: Shear-induced mechanochemistry: pushing molecules around. The Journal of Physical Chemistry C 119:7115-7123 (2015).
He, Y., Zolper, T.J., Liu, P., Zhao, Y., He, X., Shen, X., Sun, H., Duan, Q., Wang, Q.: Elastohydrodynamic lubrication properties and friction behaviors of several ester base stocks. Friction 3:243-255 (2015).
Khan, A.M., Wu, H., Ma, Q., Chung, Y.-W., Wang, Q.J. Relating tribological performance and tribofilm formation to the adsorption strength of surface-active precursors. Tribology Letters 68 (2020).
Plimpton, S. Fast parallel algorithms for short-range molecular dynamics. Journal of Computational Physics 117:1-19 (1995).
Van Duin, A.C.T., Dasgupta, S., Lorant, F., Goddard III, W.A. ReaxFF: A reactive force field for hydrocarbons. Journal of Materials Chemistry A 105:9396-9409 (2001).
Rahaman, O., van Duin, A.C.T., Goddard, W.A., Doren, D.J. Development of a reaxFF reactive force field for glycine and application to solvent effect and tautomerization. The Journal of Physical Chemistry B 115:249-261 (2011).
Stukowski, A. Visualization and analysis of atomistic simulation data with OVITO—the open visualization tool. Modelling and Simulation in Materials Science and Engineering 18:015012 (2009).
Fursey, A. Oxide films on mild steel. Nature 207:747-748 (1965).
Aryanpour, M., van Duin, A.C.T., Kubicki, J.D. Development of a reactive force field for iron-oxyhydroxide systems. The Journal of Physical Chemistry A 114:6298-6307 (2010).
Liñeira del Rio, J.M., Guimarey, M.J.G., Comuñas, M.J.P., López, E.R., Amigo, A., Fernández, J. Thermophysical and tribological properties of dispersions based on graphene and a trimethylolpropane trioleate oil. Journal of Molecular Liquids 268:854-866 (2018).
Qiao, S., Shi, Y., Wang, X., Lin, Z., Jiang, Y. Synthesis of biolubricant trimethylolpropane trioleate and its lubricant base oil properties. Energy & Fuels 31:7185-7190 (2017).
Miranda, A.M., Castilho-Almeida, E.W., Martins Ferreira, E.H., Moreira, G.F., Achete, C.A., Armond, R.A.S.Z., et al. Line shape analysis of the Raman spectra from pure and mixed biofuels esters compounds. Fuel 115:118-125 (2014).
Schonemann, A., Edwards, H.G. Raman and FTIR microspectroscopic study of the alteration of Chinese tung oil and related drying oils during ageing. Anal Bioanal Chem 400:1173-1180 (2011).

* cited by examiner

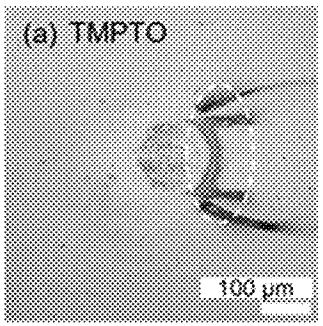
FIG. 4A
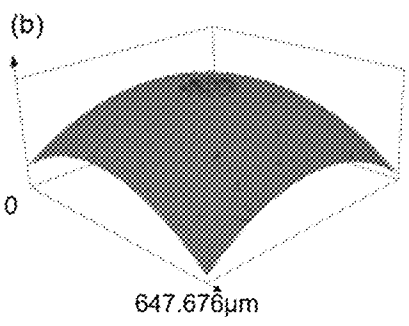
FIG. 4B
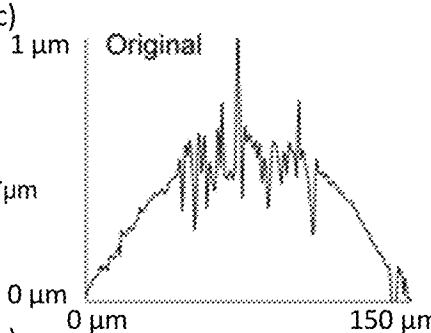
FIG. 4C
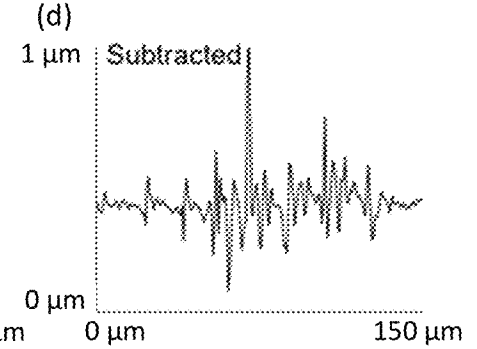
FIG. 4D
FIG. 4E
FIG. 4F
FIG. 4G
FIG. 4H Trimethylolpropane trioleate (TMPTO)

LUBRICANT COMPOSITIONS, AND SYNTHESIZING METHODS AND APPLICATIONS OF SAME

CROSS-REFERENCE TO RELATED PATENT APPLICATION

This application claims priority to and the benefit of U.S. Provisional Patent Application Ser. No. 63/009,570, filed Apr. 14, 2020, which is incorporated herein in its entirety by reference.

STATEMENT AS TO RIGHTS UNDER FEDERALLY-SPONSORED RESEARCH

This invention was made with government support under CMMI-1662606 awarded by the National Science Foundation. The government has certain rights in the invention.

FIELD OF THE INVENTION

The invention relates generally to a lubricant composition, and more particularly to a lubricant composition with a lubricant additive that can be in-situ tribopolymerized into protective tribofilm.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

There are significant economic and environmental benefits by having effective and environmentally friendly lubricant additives to reduce friction and wear. Tribopolymerization, the process of forming oligomeric/polymeric films in the presence of hydrocarbon molecules in tribocontacts, can result in reduced friction and wear under boundary lubrication conditions. Reports of tripolymerization can be dated back to the 1950's, in which tribopolymer deposit was generated on metal contacts in the presence of hydrocarbons, while others discussed the mechanistic aspect of tribopolymerization and its application to improve tribological performance. More recently, the use of vapor phase lubrication has been reported using alcohols and α-pinene that ultimately led to the formation of tribopolymers. Our group disclosed the use of cyclopropanecarboxylic acid (CPCa) as a model additive for tribopolymerization, which includes a metastable cyclopropane ring and surface-active carboxyl (—COOH) group. This additive was shown to readily undergo tribopolymerization, resulting in the generation of a wear-protective tribofilm. However, it is still a challenge to form a lubricant composition that is environment friendly, highly efficient, long-lasting, and wear preventing.

Therefore, a heretofore unaddressed need exists in the art to address the aforementioned deficiencies and inadequacies.

SUMMARY OF THE INVENTION

This disclosure relates to a lubricant composition with a lubricant additive that can be in-situ tribopolymerized into protective tribofilm. The lubricant composition includes a base lubricant and a plurality of functional lubricant additives. Lubricant additives include one or more surface-active groups attractable to target surface, and a metastable ring structure readily activated, functioning as precursor molecules to induce tribopolymerization and forming in-situ protective tribofilm with desirable robustness and low shear resistance. A less stable structure is more readily activated to the intermediate state, preferable to form more active fragments. Increasing the adsorption strength further is beneficial to prolonging the residence time of additive molecules on target surface, thereby facilitating the dissociation of molecules and subsequent polymerization.

In one aspect, the invention relates to a lubricant additive comprising one or more surface-active groups attractable to a target surface; and a carbon containing component operable connected to the one or more surface active groups, wherein the carbon containing component comprises a carbon ring structure having a high ring strain (higher than 25 kJ/mol) that is metastable and activatable with a ring-opening reaction.

In one embodiment, the one or more surface active groups and the carbon containing component are adapted such that a carbon film is operably formed in situ on the target surface only when tribological energy activates the lubricant additive to unravel the carbon containing component under a pressure and a temperature during operation.

In one embodiment, the one or more surface active groups and the carbon containing component are adapted such that the lubricant additive has a higher adsorption strength (higher than 25 kJ/mol) to allow molecules to remain on the target surface long enough to facilitate dissociation induced mechanically or thermally and subsequent polymerization to yield tribopolymers.

In one embodiment, the lubricant additive operably binds to the target surface via polar (electrostatic) or chemical interactions through the surface active group.

In one embodiment, the one or more surface active groups comprise one or more carboxyl groups, one or more hydroxyl groups, one or more siloxyl groups, one or more amine groups, or a mixture thereof.

In one embodiment, the one or more surface active groups comprise two or more carboxyl groups.

In one embodiment, increasing the number of the carboxyl groups results in stronger binding of the lubricant additive to the target surface, thereby increasing residence time and hence facilitating mechanically or thermally induced dissociation and subsequent polymerization.

In one embodiment, the lubricant additive comprises cycloalkane-carboxylic acid molecules.

In one embodiment, the cycloalkane-carboxylic acid molecules comprise cyclopropanecarboxylic acid (CPCa), cyclobutanecarboxylic acid (CBCa), cyclopropane-1,1-dicarboxylic acid (CPDCa), and cyclobutane-1,1-dicarboxylic acid (CBDCa), or a mixture thereof.

In another aspect, the invention relates to a lubricant composition used for in situ forming a carbon film on a target surface of a target machine. The lubricant composition comprises a base lubricant; and a plurality of lubricant additive molecules. Each lubricant additive molecule comprises one or more surface-active groups attractable to a target surface; and a carbon containing component operable connected to the one or more surface active groups, wherein the carbon containing component comprise a carbon ring structure having a high ring strain (e.g., higher than 25 kJ/mol) that is metastable and activatable with a ring-opening reaction.

In one embodiment, the lubricant composition has about 1-10 wt. % of the lubricant additive molecules. In one embodiment, the lubricant composition has about 0.5 wt. % of the lubricant additive molecules.

In one embodiment, the carbon film is oligomeric/polymeric in nature.

In one embodiment, the one or more surface active groups and the carbon containing component are adapted such that the carbon film is formed on the target surface of the target machine only when tribological energy activates the lubricant additive to unravel the carbon containing component under a pressure and a temperature during operation.

In one embodiment, the one or more surface active groups and the carbon containing component are adapted such that the lubricant additive has a higher adsorption strength (higher than 25 kJ/mol) to allow molecules to remain on the target surface long enough to facilitate dissociation induced mechanically or thermally and subsequent polymerization to yield tribopolymers.

In one embodiment, the lubricant additive molecules operably bind to the target surface via polar (electrostatic) or chemical interactions through the one or more surface active groups.

In one embodiment, the one or more surface active groups have positive charges, and the target surface has negative charges, and vice versa, such that the one or more surface active groups are attractable to the target surface.

In one embodiment, the one or more surface active groups comprise one or more carboxyl groups, one or more hydroxyl groups, one or more siloxyl groups, one or more amine groups, or a mixture thereof.

In one embodiment, the one or more surface active groups comprise two or more carboxyl groups.

In one embodiment, the plurality of lubricant additive molecules comprises cycloalkane-carboxylic acid molecules.

In one embodiment, the cycloalkane-carboxylic acid molecules comprises CPCa, CBCa, CPDCa, and CBDCa, or a mixture thereof.

In one embodiment, the lubricant composition has Raman features at about 1350 and 1580 $cm^{-1}$.

In yet another aspect, the invention relates to a method for in situ forming a carbon film on a target surface of a target machine. The method comprises adding the lubricant composition into the target machine, wherein the lubricant composition is in contact with the target surface of the target machine; and operating the target machine to cause a temperature and a pressure at the target surface so that the carbon containing component is unraveled thereon to form a carbon film on the target surface during the operation.

In one embodiment, the lubricant composition has about 1-10 wt. % of the lubricant additive molecules.

In one embodiment, the one or more surface active groups comprise one or more carboxyl groups, one or more hydroxyl groups, one or more siloxyl groups, one or more amine groups, or a mixture thereof.

In one embodiment, the one or more surface active groups comprise two or more carboxyl groups.

In one embodiment, the plurality of lubricant additive molecules comprises cycloalkane-carboxylic acid molecules.

In one embodiment, the cycloalkane-carboxylic acid molecules comprises CPCa, CBCa, CPDCa, and CBDCa, or a mixture thereof.

In one embodiment, the temperature is in the range of 25° C.-500° C., and the pressure is in the range of 0.1-3 Gpa.

In one embodiment, the carbon film is oligomeric/polymeric in nature.

These and other aspects of the invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

FIG. 2A: the first simulation study where 25 additive molecules (CPCa shown here) are placed on top of the passivated $Fe_3O_4$ surface. FIG. 2B: the second simulation study where 100 additive molecules are placed inside a cubic box. FIG. 2C: the third simulation study where 200 CPCDa molecules are sandwiched between substrates.

FIGS. 4A-4H show optical images (FIGS. 4A and 4E) taken from the contact point of the ball after friction test with (FIGS. 4A-4D) TMPTO and (FIGS. 4E-4H) TMPTO with 0.5 wt. % CPDCa, according to one embodiment of the invention. The profiles shown in FIGS. 4D and 4H were obtained by subtracting the wear profile by the profile of a new and cleaned ball.

(FIG. 9A) at the beginning of the simulation; (FIG. 9B) 0.5 ns after sliding starts; and (FIG. 9C) 1 ns after sliding starts, according to one embodiment of the invention. The logarithmic y-scale and the difference in x-scales for each subfigure.

DETAILED DESCRIPTION OF THE INVENTION

Figure 1:
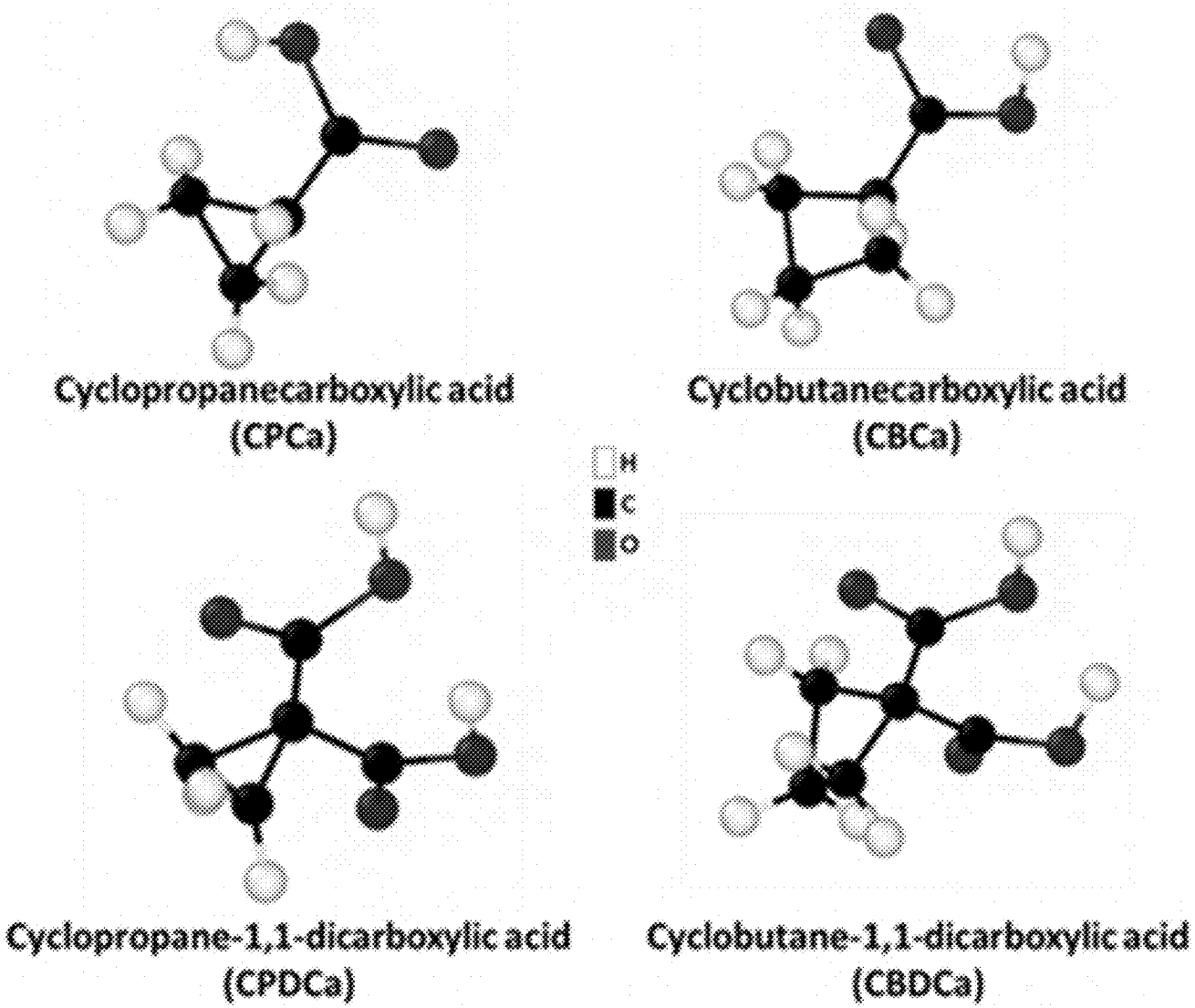
FIG. 1 shows precursor molecules according to one embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that, as used in the description herein and throughout the claims that follow, the meaning of "a", "an", and "the" includes plural reference unless the context clearly dictates otherwise. Also, it will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprises" and/or "comprising," or "includes" and/or "including" or "has" and/or "having", or "carry" and/or "carrying," or "contain" and/or "containing," or "involve" and/or "involving, and the like are to be open-ended, i.e., to mean including but not limited to. When used in this disclosure, they specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used in this disclosure, "around", "about", "approximately" or "substantially" shall generally mean within 20 percent, preferably within 10 percent, and more preferably within 5 percent of a given value or range. Numerical quantities given herein are approximate, meaning that the term "around", "about", "approximately" or "substantially" can be inferred if not expressly stated.

As used in this disclosure, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

The tribopolymerization process can be affected by, inter alia, frictional heating and shear stress. Frictional heating can thermally activate tribochemical reactions, while shear stress can accelerate such tribochemical reactions by structural distortion of reactant molecules and lowering the activation barrier. It is demonstrated that an increased tribopolymer yield occurs with chemisorbed molecules, compared with those that physisorb on surfaces.

We have recently disclosed in U.S. Pat. Nos. 10,414,997 and 10,745,637, which are incorporated herein by reference in their entireties, the use of cyclopropanecarboxylic acid (CPCa) as a model additive that can readily react under the combined effect of flash heating and stress in steel tribo-contacts to form tribopolymers, along with marked improvement in tribological performance, compared with those with the hydroxyl group (cyclopropanemethanol and 1-cyclopropylethanol). Molecular dynamics (MD) simulation results show that the former molecules bind to the iron oxide surface more strongly than the latter. One interpretation of the results is that the tribopolymerization reaction requires the precursor molecules to remain on the surface at the reaction temperature long enough for the reaction to occur. Weakly bound precursor molecules desorb before they have the chance to react. Further, stronger binding of precursor molecules to the surface allows the shear stress at the friction surface to cause structural distortion and hence contribute to activating the reaction of these precursor molecules.

This invention continues this line of enquiry by exploring if increased adsorption strength of precursor molecules may lead to further enhancement of tribopolymer formation and hence even better friction and wear performance. It is also useful to confirm that tribopolymer formation is affected by the degree of metastability of the precursor molecules. We explore these questions using four lubricant additives as examples, viz., cyclopropanecarboxylic acid (CPCa), cyclobutanecarboxylic acid (CBCa), cyclopropane-1,1-dicarboxylic acid (CPDCa), and cyclobutane-1,1-dicarboxylic acid (CBDCa), as shown in FIG. 1. CPCa includes a cyclopropane ring and a surface-active carboxyl group, while CBCa includes a cyclobutane ring and a carboxyl group. Cyclopropane has the highest ring strain (around 120 kJ/mol) among all small cycloalkane molecules with the smallest C—C—C bond angle of 60° and thus the least stable. Cyclobutane has its ring strain around 110 kJ/mol which is therefore slightly lower than that of cyclopropane. The C—C—C bond angle in cyclobutane is about 90° (cyclobutane is non-planar) and is thus more stable than cyclopropane. In comparison, CPDCa includes cyclopropane and two carboxyl groups, whereas CBDCa includes cyclobutane and two carboxyl groups. This set of precursor molecules provides us with an opportunity to explore the effect of adsorption strength and degree of metastability on tribopolymerization and tribological performance, and the dependence of tribopolymerization and tribological performance on the surface binding strength of selected cycloalkane-carboxylic acid additives.

Specifically, in one aspect, this invention relates to, among other things, a lubricant additive composition. The lubricant additive contains two moieties, one or more surface-active groups and metastable carbon ring structure. The carbon ring structure exhibiting a high ring strain (e.g., higher than 25 kJ/mol) is metastable and can be easily activated with a ring-opening reaction. However, without a high coverage of these precursor molecules, the formation of tribopolymer at tribo-contacts can still not be achieved. Thus, for the occurrence of tribochemical reaction and the efficient formation of lubricious tribopolymer, a strong binding strength is a necessary condition. Compared with hydroxyl group, carboxyl group is more efficient for this purpose, because weakly bound precursor molecules desorb before they have the chance to react. Increasing the number of carboxyl groups results in stronger binding of lubricant additive to steel surface, thus increasing the residence time and hence facilitating mechanically or thermally induced dissociation and subsequent polymerization. The tribopolymerization process is induced under the combined effect of flash heating and shear stress, along with marked improvement in tribological performance. Specifically, lubricant molecules with two carboxyl groups perform much better than those with a single carboxyl group, and replacing cyclopropane ring with less strained cyclobutane ring increases friction and wear slightly. The new findings reveal that CPDCa and CBDCa are also good (or better) chemicals for the same or broader applications, and more carboxyl groups can enhance the friction polymer formation.

According to the invention, the lubricant additives are phosphorus-free and sulfur-free. Continual formation of lubricious tribopolymer occurs during the operation. Tribopolymer is self-replenishing at rubbing surfaces.

In certain embodiments, the lubricant additive includes one or more surface-active groups attractable to a target surface; and a carbon containing component operable connected to the one or more surface active groups, wherein the carbon containing component comprises a carbon ring structure having a high ring strain (>25 kJ/mol) that is metastable and activatable with a ring-opening reaction.

In certain embodiments, the one or more surface active groups and the carbon containing component are adapted such that a carbon film is operably formed in situ on the target surface only when tribological energy activates the lubricant additive to unravel the carbon containing component under a pressure and a temperature during operation.

In certain embodiments, the one or more surface active groups and the carbon containing component are adapted such that the lubricant additive has a higher adsorption strength (higher than 25 kJ/mol) to allow molecules to remain on the target surface long enough to facilitate dissociation induced mechanically or thermally and subsequent polymerization to yield tribopolymers.

In certain embodiments, the lubricant additive operably binds to the target surface via polar (electrostatic) or chemical interactions through the surface active group.

In certain embodiments, the one or more surface active groups comprise one or more carboxyl groups, one or more hydroxyl groups, one or more siloxyl groups, one or more amine groups, or a mixture thereof.

In certain embodiments, the one or more surface active groups comprise two or more carboxyl groups.

In certain embodiments, increasing the number of the carboxyl groups results in stronger binding of the lubricant additive to the target surface, thereby increasing residence time and hence facilitating mechanically or thermally induced dissociation and subsequent polymerization.

In certain embodiments, the lubricant additive comprises cycloalkane-carboxylic acid molecules. In certain embodiments, the cycloalkane-carboxylic acid molecules comprise CPCa, CBCa, CPDCa, and CBDCa, or a mixture thereof.

In use, the lubricant additive is mixed with a base lubricant with suitable composition before use.

In certain embodiments, the lubricant composition comprises a base lubricant; and a plurality of lubricant additive molecules, as disclosed above. Each lubricant additive molecule comprises one or more surface-active groups attractable to a target surface; and a carbon containing component operable connected to the one or more surface active groups, wherein the carbon containing component comprise a carbon ring structure having a high ring strain (e.g., higher than 25 kJ/mol) that is metastable and activatable with a ring-opening reaction.

In certain embodiments, the lubricant composition has about 1-10 wt. % of the lubricant additive molecules. In one embodiment, the lubricant composition has about 0.5 wt. % of the lubricant additive molecules.

In certain embodiments, the carbon film is oligomeric/polymeric in nature.

In certain embodiments, the lubricant composition has Raman features at about 1350 and 1580 $cm^{-1}$.

In another aspect, the invention relates to a method for in situ forming a carbon film on a target surface of a target machine. The method comprises adding the lubricant composition into the target machine, wherein the lubricant composition is in contact with the target surface of the target machine; and operating the target machine to cause a temperature and a pressure at the target surface so that the carbon containing component is unraveled thereon to form a carbon film on the target surface during the operation.

In certain embodiments, the temperature is in a range of 25° C.-500° C., and the pressure is in a range of 0.4-2 Gpa.

These and other aspects of the present invention are further described below. Without intent to limit the scope of the invention, exemplary instruments, apparatus, methods and their related results according to the embodiments of the present invention are given below. Note that titles or subtitles may be used in the examples for convenience of a reader, which in no way should limit the scope of the invention. Moreover, certain theories are proposed and disclosed herein; however, in no way they, whether they are right or wrong, should limit the scope of the invention so long as the invention is practiced according to the invention without regard for any particular theory or scheme of action.

Example

Dependence of Tribological Performance and Tribopolymerization on the Surface Binding Strength of Selected Cycloalkane-Carboxylic Acid Additives In this non-limiting exemplary example, dependence of tribological performance and tribopolymerization on the surface binding strength of selected cycloalkane-carboxylic acid additives is investigated. Results of how chemical structural modification of CPCa may impact on the formation of tribopolymers and hence friction and wear properties are presented, both by experiments and molecular dynamics simulation. Four lubricant additives were studied, which include CPCa, CBCa, CPDCa, and CBDCa, each of which includes a metastable ring structure and one or two carboxyl groups dissolved in an ester base oil. Friction and wear rate using these additives rank in the order of CPDCa<CBDCa<CPCa<CBCa. Raman spectroscopy analysis reveals that these additive molecules form tribopolymer films at the contact area. Molecular dynamics simulation shows that CPCa with the less stable cyclopropane ring fragments more readily than CBCa. Such fragmentation appears to be essential for subsequent tribopolymerization and formation of protective tribofilms. These simulations further demonstrate that having two carboxyl groups as in the case of CPDCa results in stronger binding of the additive molecules to the surface, thus increasing the residence time and hence facilitating mechanically or thermally induced dissociation and subsequent polymerization. The net result is that CPDCa gives the lowest friction and negligible wear under the testing conditions. The new findings reveal that CPDCa and CBDCa are also good (or better) chemicals for the same or broader applications, and more carboxyl groups can enhance the friction polymer formation.

Experimental Results on Friction and Wear

Figure 10:
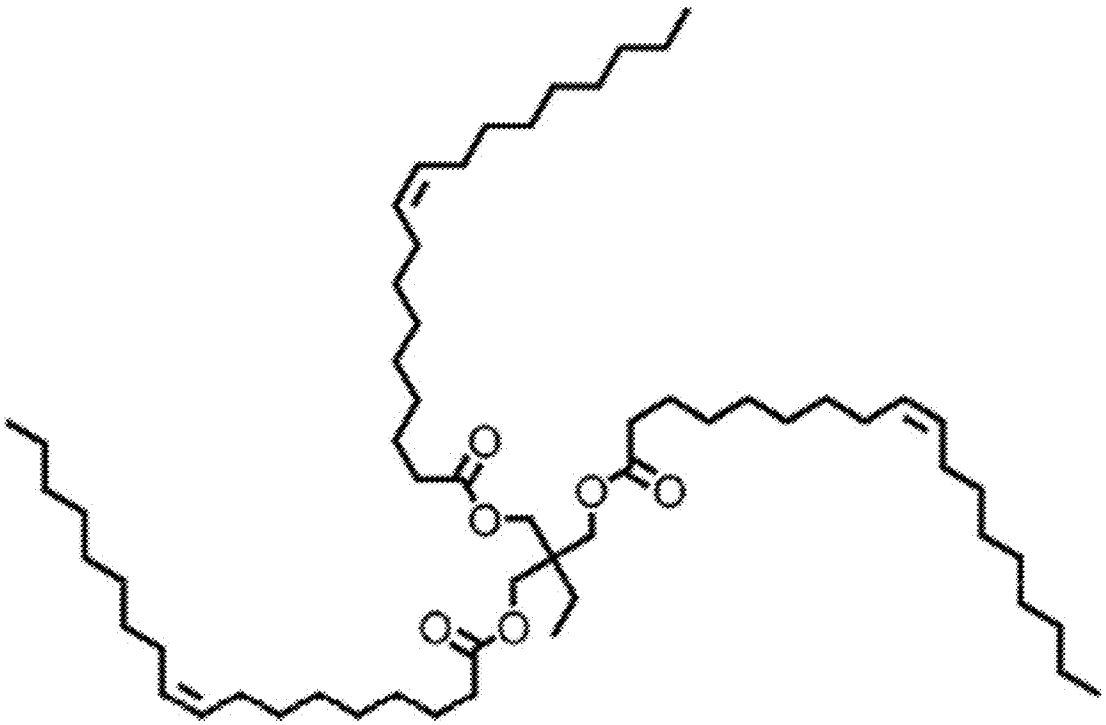
FIG. 10 shows chemical structure of TMPTO (trihydroxymethylpropyl trioleate) base oil.

CPCa (purity=95%, melting point=288 K), CBCa (purity=97%, melting point=266 K), CPDCa (purity=97%, melting point=408 K), CBDCa (purity=99%, melting point=431 K), formic acid (purity=95%), $Fe_3O_4$ nanoparticles (50-100 nm, purity=97%), and dichloromethane (purity=99.8%) were obtained from Sigma-Aldrich and used as received. Trimethylolpropane trioleate (TMPTO), a polyolester oil with desirable compatibility with polar additives, was obtained from China Petrochemical Corporation and used for this work. The chemical structure and physical properties of this oil are shown in FIG. 10 and Table 1. For each precursor additive, a loading of about 0.5 weight percent (wt. %) was used, followed by three-hour ultrasonication to ensure uniform mixing.

TABLE 1

| Physical properties of the TMPTO at 303 K | |
|---|---|
| Density ($g/cm^3$) | 0.91 |
| Viscosity (mPa · s) | 75.0 |
| Pressure-viscosity index ($GPa^{-1}$) | 15.1 |

Figure 11B:
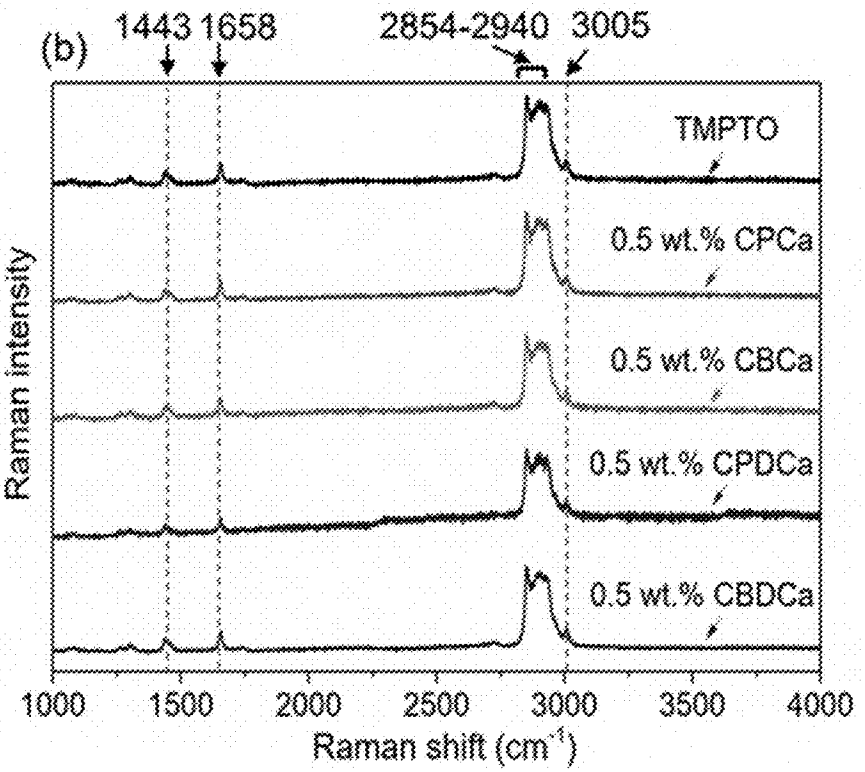
FIGS. 11A-11B show respectively FTIR and Raman spectra obtained from five lubricant formulations, according to one embodiment of the invention.
Figure 11A:
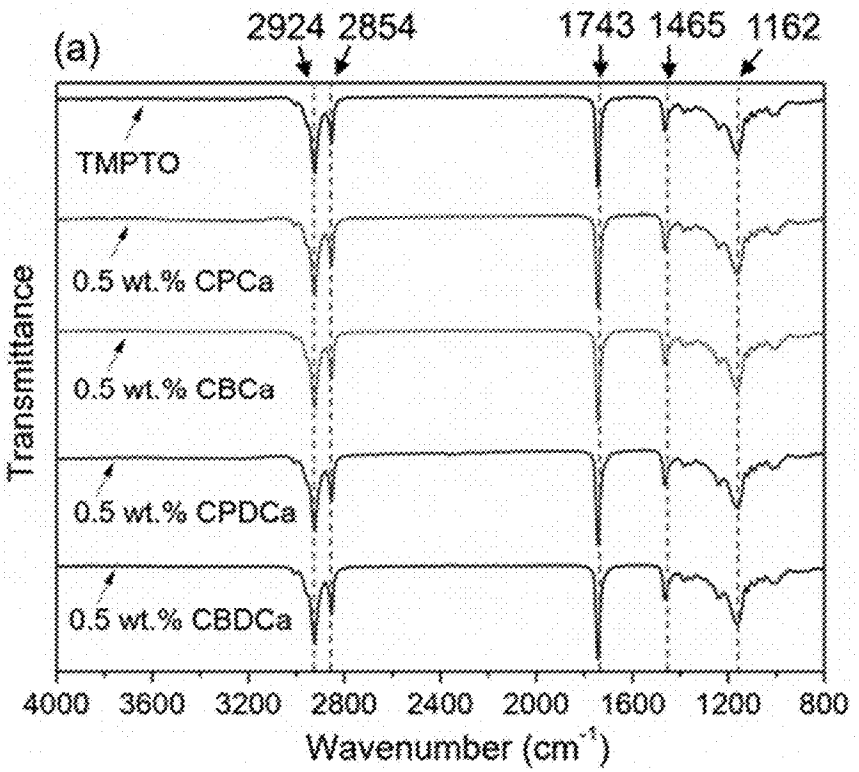

Prior to the friction test, the five lubricant formulations (pure TMPTO, TMPTO+0.5 wt. % CPCa, TMPTO+0.5 wt. % CBCa, TMPTO+0.5 wt. % CPDCa, and TMPTO+0.5 wt. % CBDCa) were characterized by micro-FTIR (Bruker LUMOS) and Raman spectroscopy (HORIBA LabRAM HR Evolution, with spot size of about 2 μm). FIG. 11A shows that pure TMPTO gives five major FTIR peaks at 2924 $cm^{-1}$, 2854 $cm^{-1}$, 1743 $cm^{-1}$, 1465 $cm^{-1}$ and 1162 $cm^{-1}$, corresponding to C—H asymmetric stretching, C—H symmetric stretching, C═O stretching, C—H bending, and C—O—H stretching, respectively. The Raman spectrum of pure TMPTO, shown in FIG. 11B, exhibits four main peaks at 1443 $cm^{-1}$, 1658 $cm^{-1}$, 2854-2960 $cm^{-1}$ and 3005 $cm^{-1}$, corresponding to C═C stretching, C═O stretching, C—H stretching and C—H cis conformation, respectively. Incorporation of about 0.5 wt. % additive into the base oil does not affect any spectral features, indicating the absence of any chemical reaction between the base oil and any of the additive molecules. As shown in FIGS. 11A-11B, there is no chemical reaction between the base oil and any of the additive molecules. To simplify labeling in all subsequent figures, the five lubricant formulations are named as TMPTO, 0.5 wt. % CPCa, 0.5 wt. % CBCa, 0.5 wt. % CPDCa, and 0.5 wt. % CBDCa. The corresponding mole concentrations of CPCa, CBCa, CPDCa and CBDCa are 0.05 mol/L, 0.045 mol/L, 0.035 mol/L and 0.032 mol/L, respectively.

The friction test was conducted under ambient conditions (about 295-298 K and about 22-24% relative humidity), using a ball-on-disk tribometer (CETR UMT-2 tribometer). Balls (φ=9.5 mm, $R_a$=20 nm) and disks (φ=30 mm, thickness=5 mm), made of AISI 52100 bearing steel with hardness of 60 HRC, were purchased from McMaster-Carr. The balls were used as received. Disks were polished using SiC sand papers to a final surface finish $R_a$ of about 30 nm. The test duration was fixed at about 2 hours. Each friction test was repeated three times.

The friction tests using TMPTO with and without additive molecules were conducted under 10 N and 50 mm/s. The lubricant film thickness and the lambda ratio were estimated using the Hamrock-Dowson equation to be about 12 nm and about 0.33, respectively. This indicates that the test was operating in the boundary lubrication regime, at least in the initial stage of the friction test.

Figure 3A:
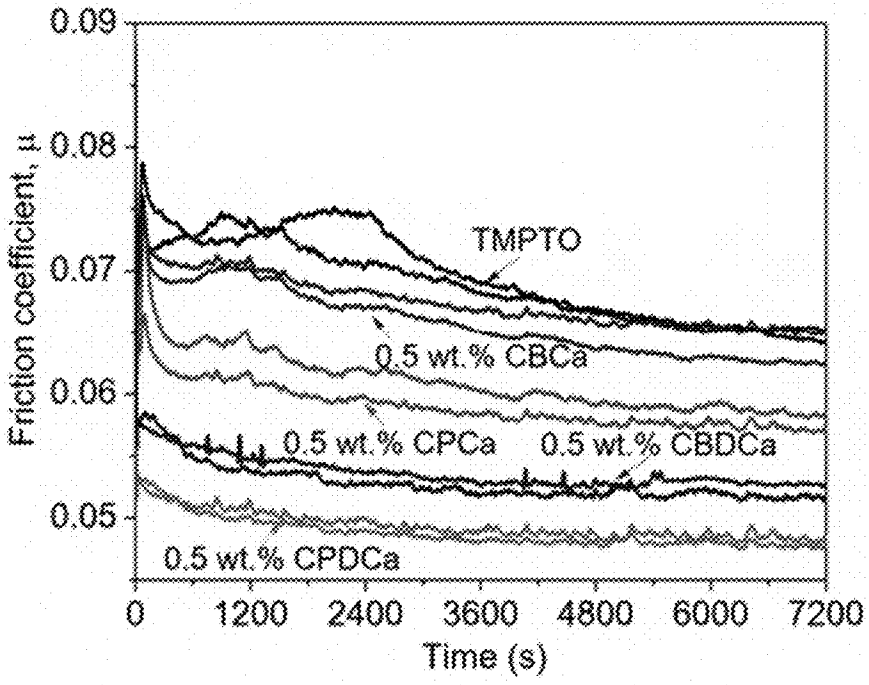
FIGS. 3A-3C show the friction behavior of steel tribopairs with different lubricants at 10 N and 50 mm/s; and corresponding wear rate of the ball according to one embodiment of the invention.
Figure 3B:
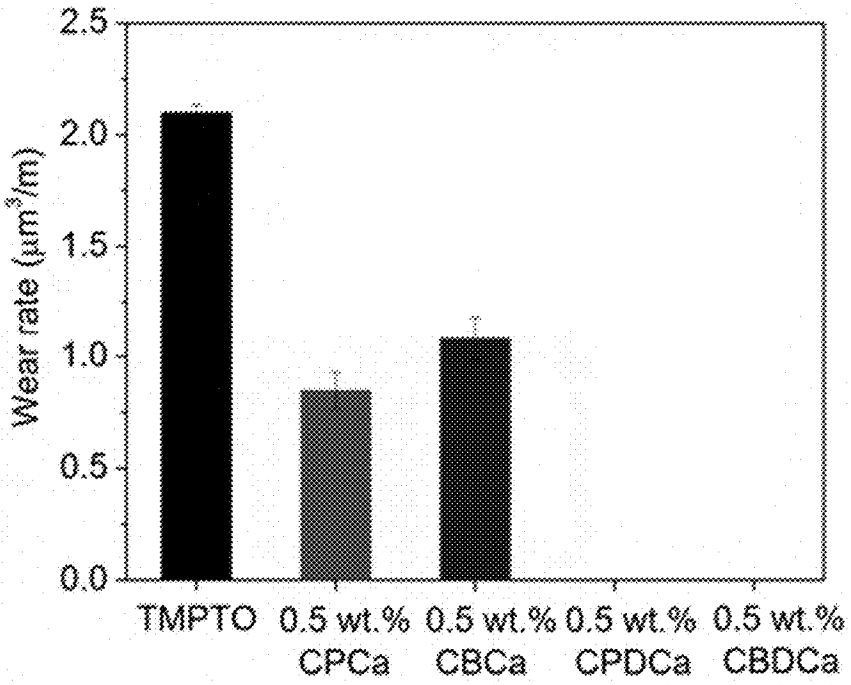

FIG. 3A illustrates how the friction coefficient and wear rate of balls vary as a function of time using these five TMPTO lubricant formulations tested at a load of 10 N and sliding speed of 50 mm/s. The friction coefficient follows this order: CPDCa<CBDCa<CPCa<CBCa<TMPTO. The more striking comparison is the wear performance as shown in FIG. 3B. Compared with the pure base oil, addition of 0.5 wt. % CPCa or CBCa reduces the wear by about 50%. With addition of 0.5 wt. % CPDCa or CBDCa, no obvious wear could be observed. Optical images of the ball after friction test show normal abrasive wear using TMPTO, but hardly any wear using TMPTO with 0.5 wt. % CPDCa, as shown in FIGS. 4A and 4E.

Figure 3C:
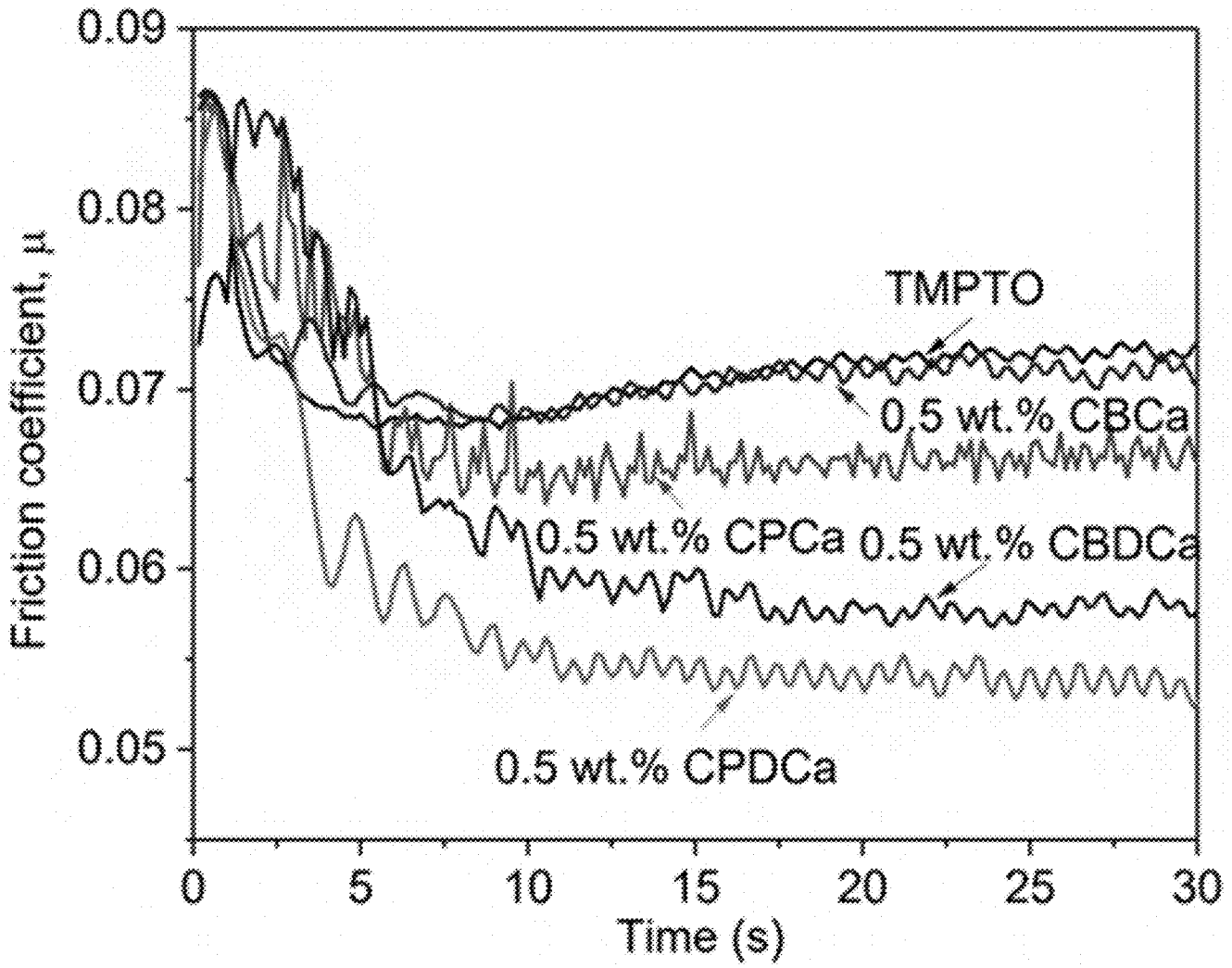

FIG. 3C shows the variation of friction coefficient during the first 30 s of sliding. All friction curves, with or without additives, start in the same range of 0.075-0.085. Depending on the additive, the friction coefficient drops to the respective low value within 30 s. It is shown that tribochemical reactions to form lubricious and wear-protective tribopolymers are initiated during these transitions.

The above observations can be rationalized as follows. Because of the metastable cyclopropane ring, adsorbed CPCa molecules can readily decompose and form tribopolymer films, which help to reduce friction and wear. The cyclobutane ring of CBCa is less strained. Therefore, CBCa forms tribopolymer films with slower kinetics, thereby resulting in less favorable tribological performance compared with CPCa. As discussed above, stronger binding of these metastable molecules to the surface should facilitate both mechanically and thermally assisted dissociation. It is reasonable to assume that having two carboxyl groups per molecule, as in the case of CPDCa and CBDCa, should result in their stronger binding to surfaces, which is further discussed in the section on molecular dynamics (MD) simulation results.

Figure 5B:
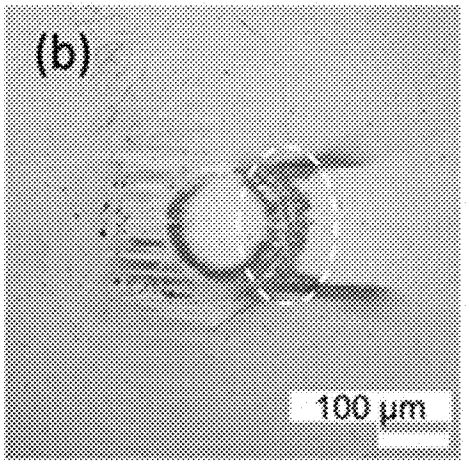
FIGS. 5A-5C show respectively Raman spectra (FIG. 5A) obtained from deposits near the trailing edge of the contact point on the ball after friction testing using pure TMPTO and TMPTO with different precursor additives; and optical images (FIGS. 5B-5C) of the ball after tribotesting in 0.5 wt. % CPDCa, followed by rinsing with (FIG. 5B) hexane and (FIG. 5C) dichloromethane, according to one embodiment of the invention.
Figure 5C:
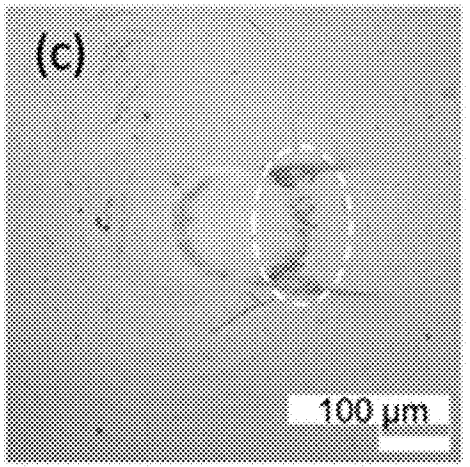
Figure 5A:
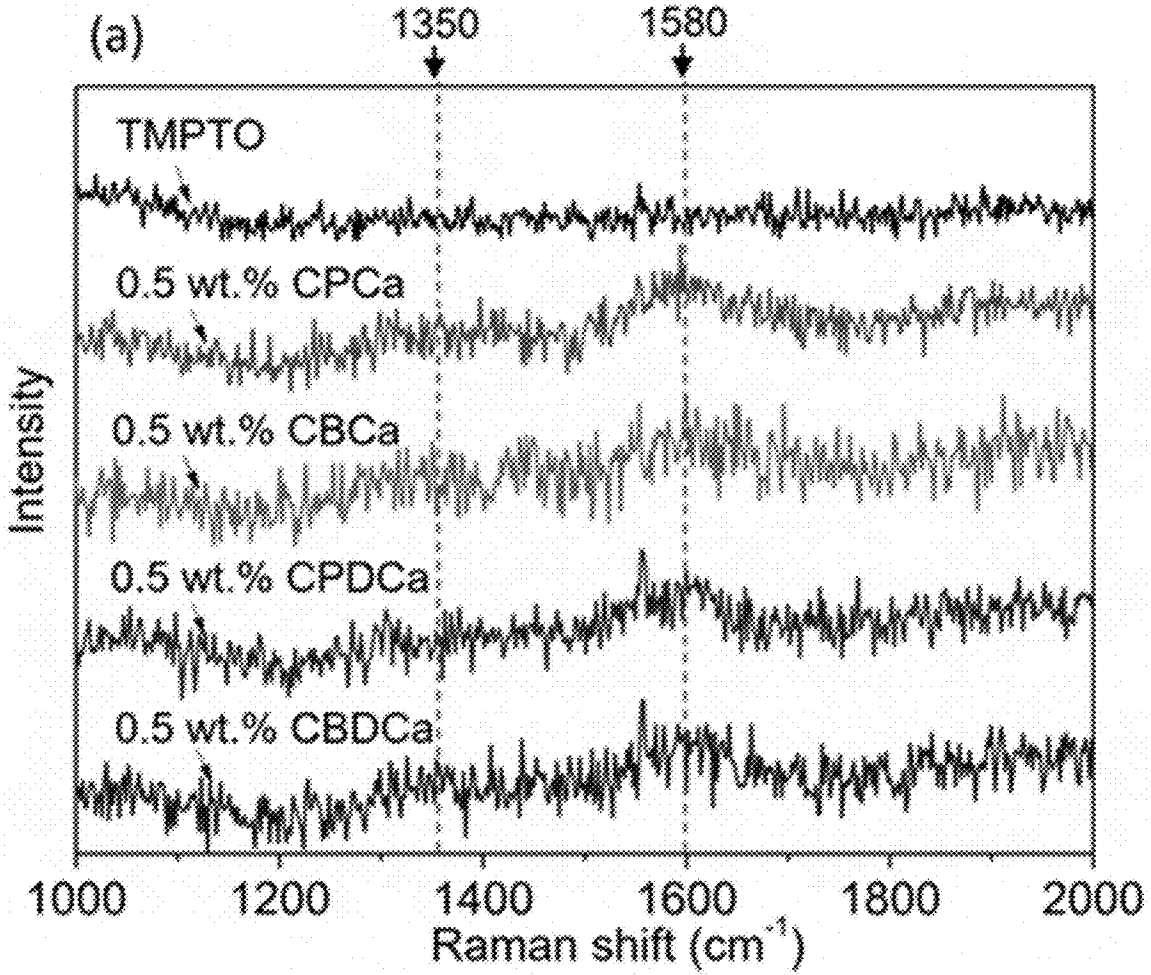
Figure 6:
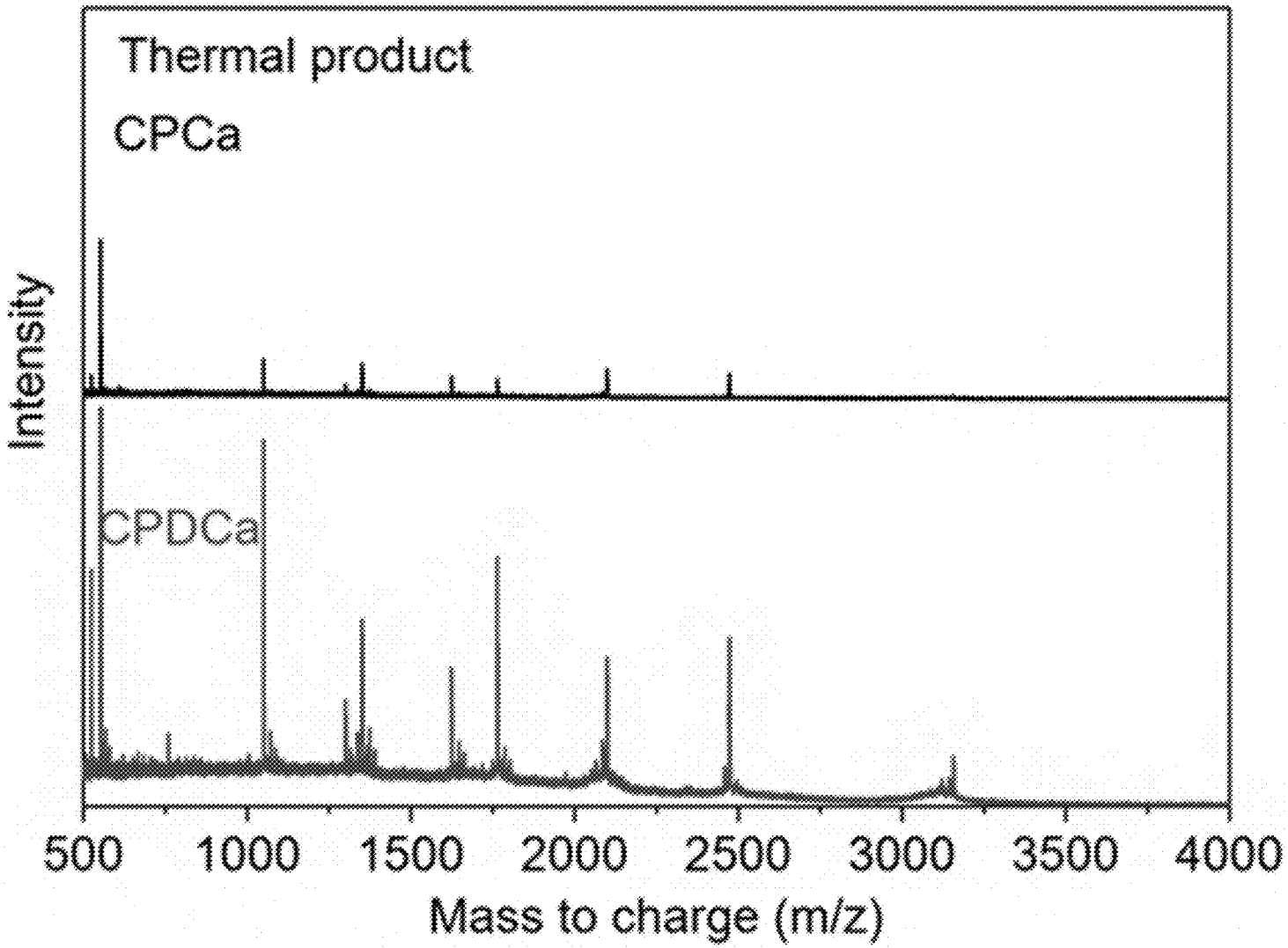
FIG. 6 shows MALDI-ToF mass spectra of the thermal products obtained from reaction of CPCa and CPDCa with $Fe_3O_4$ nanoparticles at 200° C., according to one embodiment of the invention.

After the friction test, the tested ball surfaces were rinsed in hexane to remove the residual oil. Then they were imaged with an optical microscope and analyzed by a 3D laser measuring microscope (Bruker Olympus). Deposits accumulated near the trailing edges were further characterized by Raman spectroscopy. FIG. 5A shows a series of Raman spectra taken from the deposit near the trailing edge of the contact point on the ball after friction testing. The deposit produced after testing with pure TMPTO appears to be wear debris and shows no obvious Raman peak in the 1200-2000 $cm^{-1}$ range. On the other hand, deposits produced after testing with additive molecules of CPCa, CBCa, CPDCa, and CBDCa all show Raman features at about 1350 and 1580 $cm^{-1}$. As demonstrated in our previous investigation, these are not due to the formation of conventional diamond-like carbon films; rather, they are due to the formation of tribo-oligomers/polymers that act to prevent direct asperity contact and provide wear protection of the friction pairs. The patchy nature of the deposit precludes us from making quantitative comparison among different additives. FIG. 5B is an optical image of the ball after tribotesting in 0.5 wt. % CPDCa. Rinsing with hexane results in no change in the appearance of the dark-colored deposit (compare with FIG. 4E). On the other hand, rinsing with dichloromethane results in the dissolution of most of the deposit (FIG. 5C), indicating that it is not conventional diamond-like carbon. Mass spectrometry analysis indicates that such deposit is oligomeric/polymeric in nature.

Thermal tests were performed on CPCa and CPDCa by heating 0.3 g of each precursor with 0.1 g $Fe_3O_4$ nanoparticles at 200° C. for 2 h. The reaction product was dissolved in formic acid. The solution was filtered and allowed to evaporate. The resulting solid (labeled as thermal product) was examined with MALDI-ToF (matrix assisted laser desorption ionization-time of flight, Bruker AutoFlex-III), in which 2,5-dihydroxybenzoic acid was used as the matrix.

Molecular Dynamics (MD) Simulations

In the process of interpreting experimental data as to why CPDCa is such a good additive, two assertions are made: (1) CPDCa has two carboxyl groups and should bind more strongly to the surface than CPCa. This stronger binding allows the molecule to remain on the surface at higher temperatures and higher shear stresses, both facilitating its dissociation; (2) Molecules with the cyclopropane moiety should be easier to dissociate compared with those with cyclobutane, due to the greater degree of ring strain in the former.

MD simulation studies are performed to explore these two assertions. The MD simulations were conducted by using the large-scale atomic/molecular massively parallel simulator (LAMMPS). The reactive force field (ReaxFF) method with a highly transferable force field appropriate for hydrocarbons was employed in this study. The complete details of ReaxFF have been described previously by van Duin et al. The Fe and the C/H/O parameters used are from the work by Obaidur et al. Throughout the simulation, a time step of about 0.25 fs was used. Molecular visualizations were done by the OVITO software.

In the exemplary study, three simulation studies were conducted to complement the experimental investigations.

Figure 2C:
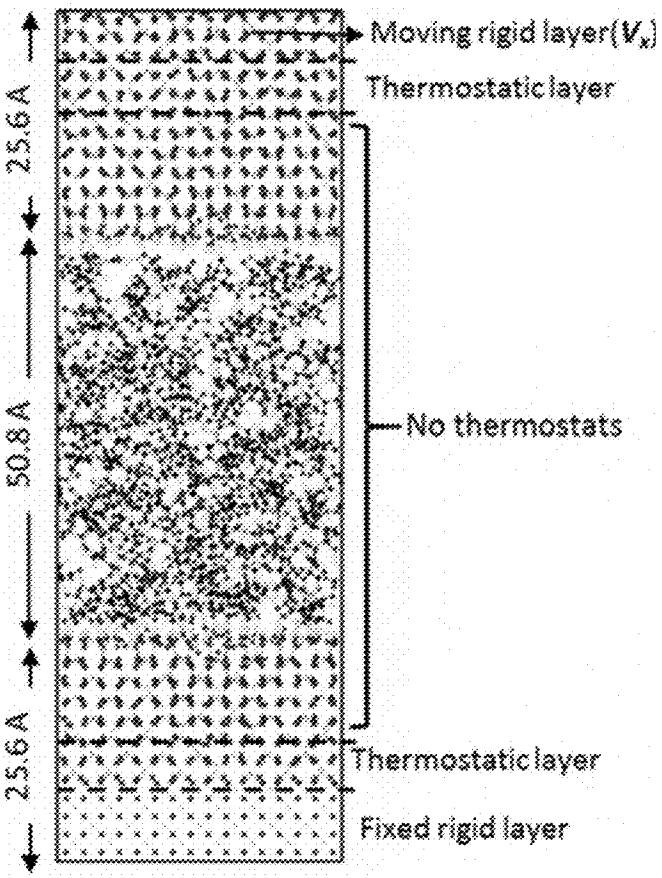
FIGS. 2A-2C show initial simulation configuration according to embodiments of the invention.
Figure 2B:
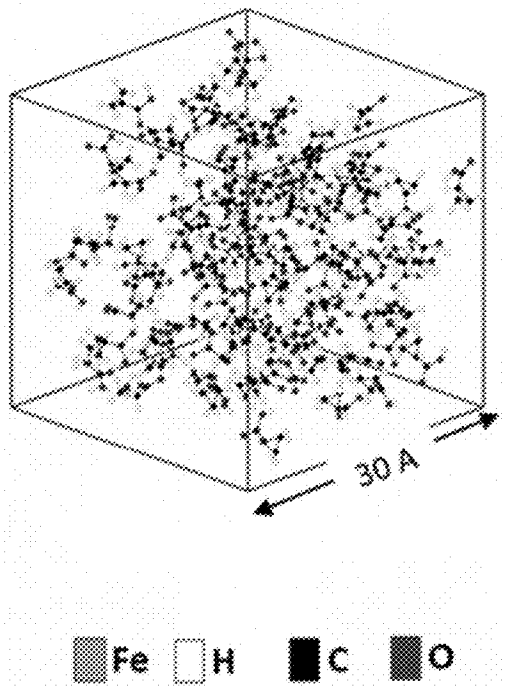
Figure 2A:
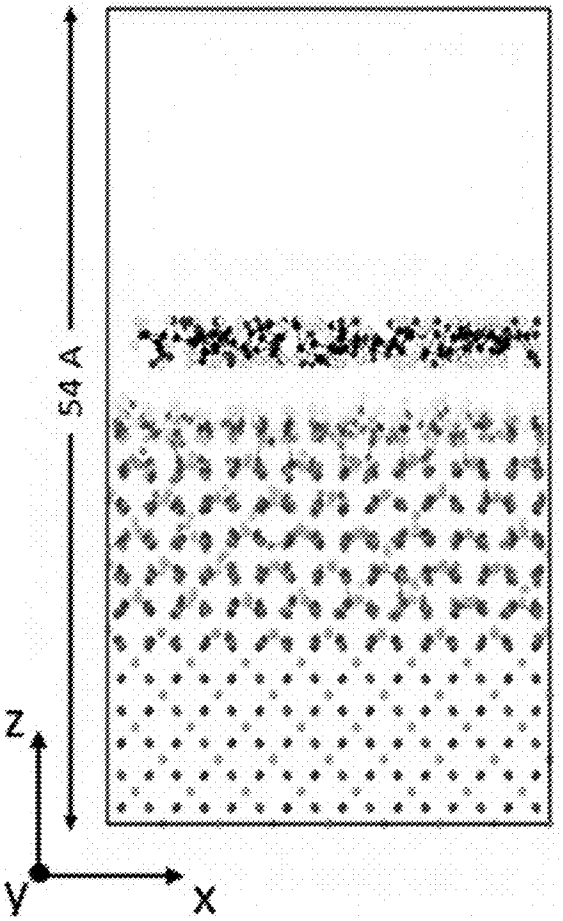

The first simulation study is aimed at comparing the adsorption strength of the precursor additive molecules with one carboxyl group versus that of molecules with two carboxyl groups. The atomistic simulation model for this purpose includes an iron oxide ($Fe_3O_4$) substrate with 25 additive molecules on top of it. $Fe_3O_4$ was chosen as the substrate because it is a common oxide phase present on lightly alloyed steel surfaces due to air exposure. The $Fe_3O_4$ surface was passivated by saturating it with an initial layer of hydrogen atoms and relaxed for about 100 ps at about 300 K before introducing the additive molecules. The initial dimension of this setup is shown in FIG. 2A, being about 34.13 Å, 34.13 Å, and 54 Å in the x, y, and z-directions, respectively. Periodic boundary conditions were applied along the x- and y-directions, and the atoms present at the bottom 10 Å of $Fe_3O_4$ were fixed to their initial positions. The simulation was conducted in two stages: (a) the equilibrium stage, in which 25 adsorbate molecules placed on top of the substrate were allowed to get adsorbed and equilibrated on the surface at about 300 K, and (b) the desorption stage, in which the temperature of the system is raised to about 400 or about 450 K to allow for desorption of these molecules. The equilibrium stage was conducted for about 100 ps, enough for equilibrium to set in. The desorption stage of the simulation was conducted for about 300 ps. Note that temperatures chosen here are not representative of what are normally measured in thermal desorption experiments. Rather, they are chosen to conveniently depict the desorption comparison between CPCa and CPDCa within the short time frame (100 ps–1 ns) obtainable in MD.

Figure 7A:
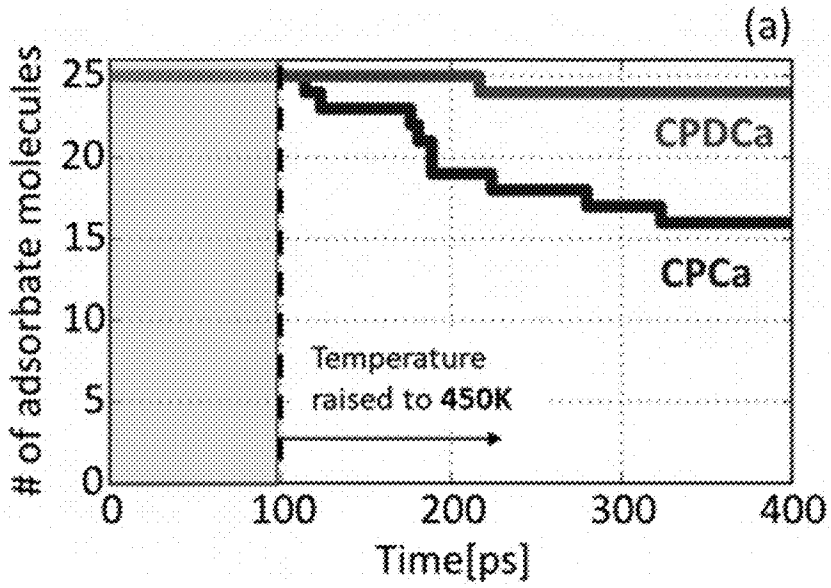
FIGS. 7A-7B show comparison of the number of adsorbed CPCa and CPDCa molecules at (FIG. 7A) 450 K and (FIG. 7B) 500 K as a function of time, according to one embodiment of the invention.
Figure 7B:
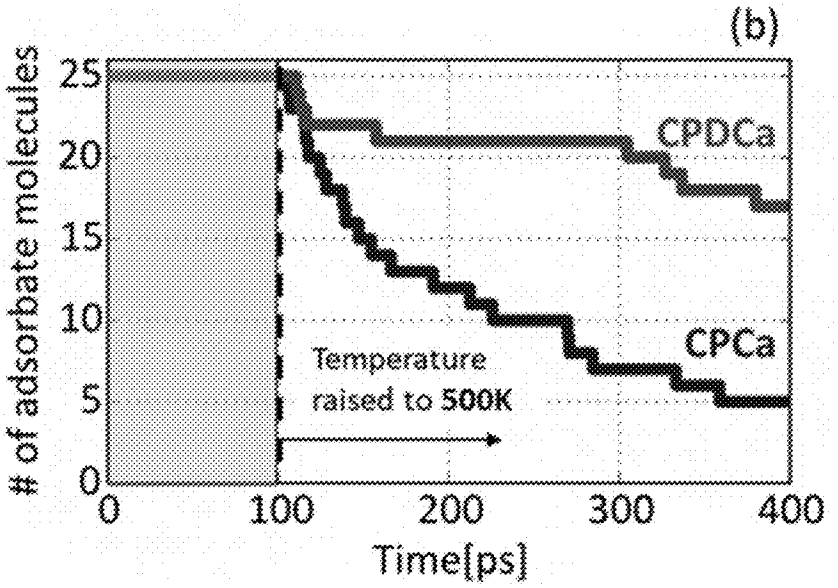
Figure 12A:
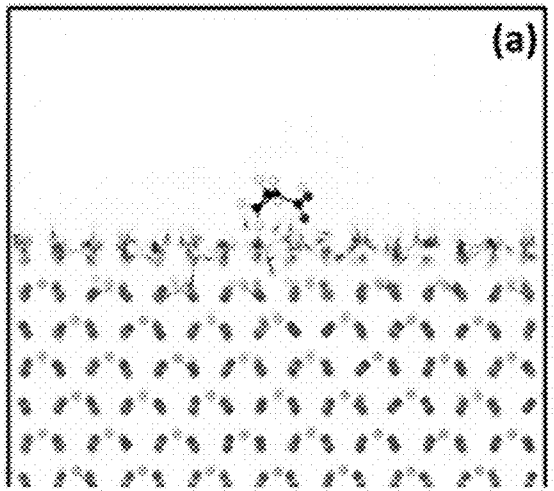
FIGS. 12A-12C show respectively CPCa adsorbed onto an iron oxide surface at 300K; iron oxide surface only; and CPCa molecule only, according to one embodiment of the invention.
Figure 12B:
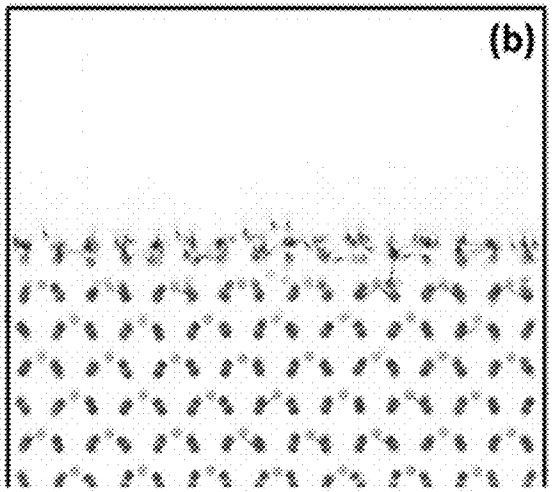
Figure 12C:
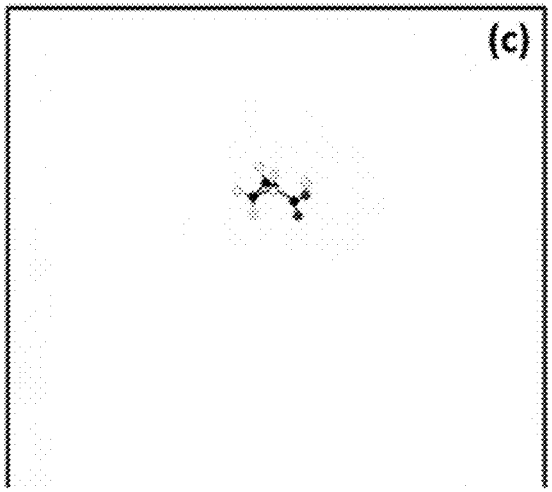

In the first set of MD simulation studies, the center of mass (CoM) of a given additive molecule above the surface is monitored at a specific temperature. An important detail that needs to be resolved is the critical distance between the CoM of the molecule and the surface below which the molecule is considered as being adsorbed on the surface. Here, the radius of a molecule is defined as the distance between the CoM and the furthest atom of the molecule. Using this definition, this radius is found to be 2.86 Å for CPCa and 3.43 Å for CPDCa, respectively. The critical distance is set to be two times the radius of the molecule under investigation. At this critical distance, the CoM of the molecule is at one molecular diameter from the surface. This is a reasonable representation of an adsorbed molecule on the surface at elevated temperatures. FIGS. 7A-7B show the temporal evolution of the number of adsorbed CPCa and CPDCa molecules at 450 K and 500 K. It should be noted that the first-time segment of 100 ps corresponds to the equilibration time and that temperature rise only begins at 100 ps. The MD results shown in this figure reveal that at 450 K, 16 CPCa molecules out of 25 remain on the surface at 400 ps, while all but one CPDCa molecules stay adsorbed. At 500 K, more desorption is observed as expected. At 400 ps, only 5 CPCa molecules remain on the surface as compared to 16 CPCDa molecules. This result is consistent with the calculated heat of adsorption for CPCa and CPDCa, which are −53.2 kJ/mol and −103.6 kJ/mol, respectively, as shown in FIGS. 12A-12C. First, the molecule is allowed to adsorb onto the surface at 300 K and survey all possible surface sites and molecular orientations (FIG. 12A). The minimum energy of the system is recorded. Second, the molecule is removed from the system, and the minimum energy of the remaining system is calculated (FIG. 12B). Finally, the minimum energy of the stand-alone molecule is calculated (FIG. 12C). The heat of adsorption is then obtained by subtracting the energy for FIG. 12A from the sum of FIGS. 12B-12C. Using this procedure, the heat of adsorption was calculated to be −53.2 kJ/mol for CPCa and −103.6 kJ/mol for CPDCa. These simulation results suggest that at a given temperature, more CPDCa molecules are present on the surface than CPCa molecules. This increases the likelihood of tribochemical reactions for CPDCa to form tribopolymer films, resulting in better tribological performance as evident from the experiments.

The second simulation study is targeted at comparing the degradation of CPCa and CBCa to shed some light on the relative stability of the molecules. As shown in FIG. 2B, 100 molecules of one precursor additive are included in the simulation box as the initial configuration. As the first step, the initial configuration was set under atmospheric conditions (1 atm and 300 K) for about 100 ps, enough to relax the system. In the second step, the temperature of the system was raised to about 1273 K, while keeping the volume constant. The number of additive molecules was monitored as a function of time at each temperature to obtain the thermal dissociation rates. In order to identify and analyze the fragments dynamically produced during the simulation, a bond order cutoff of about 0.3 Å was employed for all atoms. The choice of the cutoff does not affect the chemical reactions and is only used for the analysis of the intermediates and products formed during the MD simulation.

Figure 8:
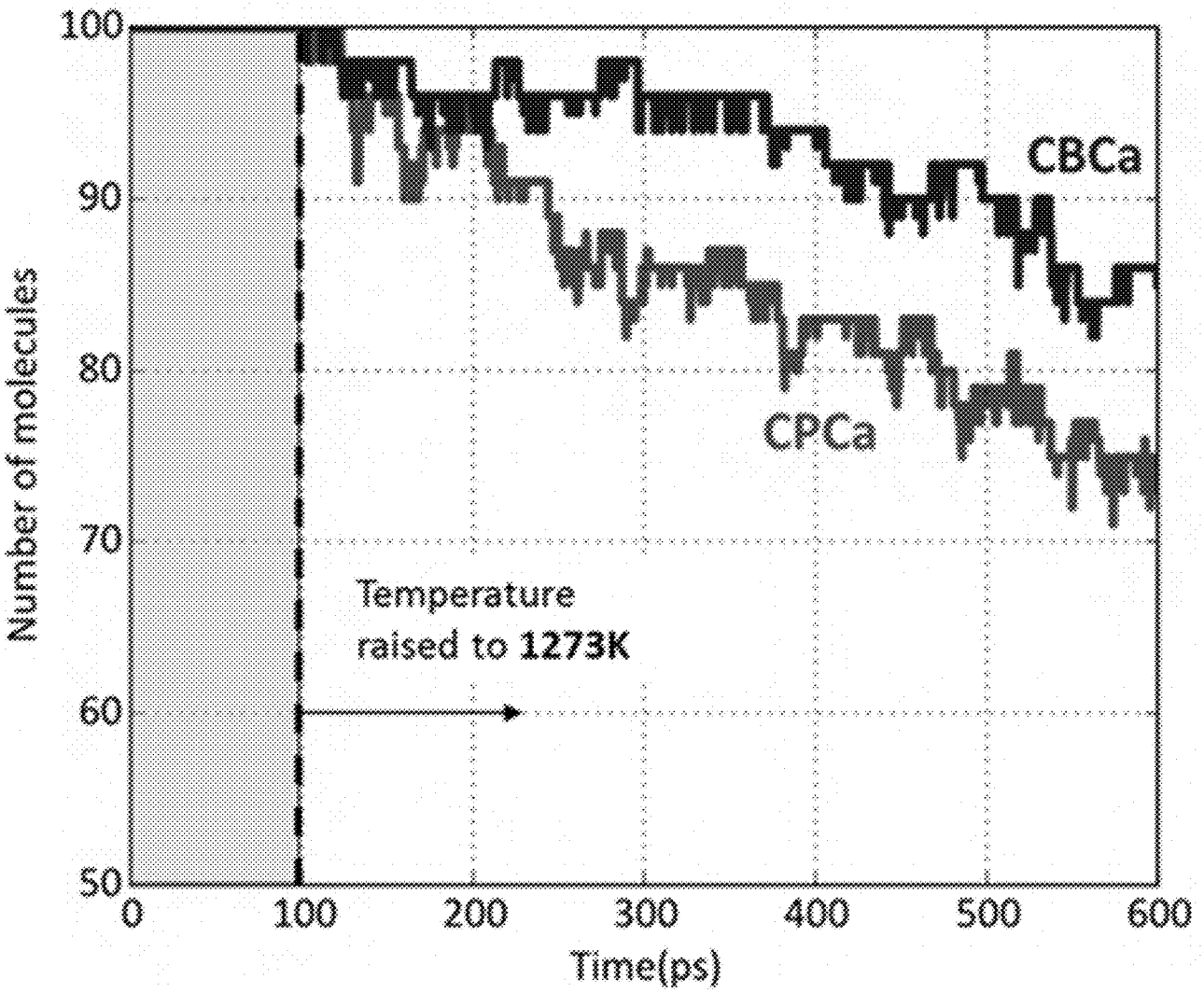
FIG. 8 shows thermal dissociation of CPCa and CBCa molecules at 1273 K as a function of time, according to one embodiment of the invention.

In the second set of simulation studies, the degradation of CPCa and CBCa at 1273 K was compared. Initial 100 ps correspond to equilibrium phase, after which the system is maintained at 1273 K. For each system, the chemical state of 100 molecules were monitored. FIG. 8 shows the degradation of 100 molecules with time as measured by the number of remaining molecules. At 600 ps, 84 CBCa molecules remain whereas 72 CPCa molecules remain, demonstrating the as-expected higher stability of CBCa as compared to that of CPCa. These results indicate that CPCa molecules, with their three-carbon rings, have significantly smaller activation energy for dissociation than CBCa molecules with four-carbon rings.

The third simulation study is to compare the product obtained from the sliding simulation of CPDCa and from CPCa. The product formed when 200 CPCa molecules were placed between $Fe_3O_4$ substrate and subjected to sliding was investigated. The similar procedure was used here to explore the product formed from 200 CPCDa molecules. The initial dimensions for this setup were about 34.13 Å, 34.13 Å, and 102 Å in the x, y, and z-directions, respectively. Periodic boundary conditions were applied along the x- and y-directions. Reactive force field (ReaxFF) developed for iron-oxyhydroxide system was used in this simulation. The simulation was conducted in three stages. An equilibrium phase (about 300 K and 1 atm) is first conducted for about 50 ps following which the simulation domain is divided in the z-direction as shown in FIG. 2C. A normal load corresponding to 3 GPa was then applied to topmost rigid layer while keeping bottom rigid layer fixed for another 50 ps. Finally, the sliding phase was conducted for 1 ns where a sliding speed $V_x$ of 10 m/s was applied to the topmost rigid layer while maintaining the normal load simultaneously. For the dissipation of heat produced during sliding, a thermostat maintained at 473 K was coupled to layers adjacent to the top and bottom rigid layers. Time step of about 0.25 fs was used for this simulation. To identify and analyze the fragments produced during the simulation, a bond order cutoff of about 0.3 was employed for intra-atomic combinations of CPDCa and iron oxide whereas the bond order cutoff of 1.0 was used for their inter-atomic combinations.

Figures 9A, 9B, 9C:
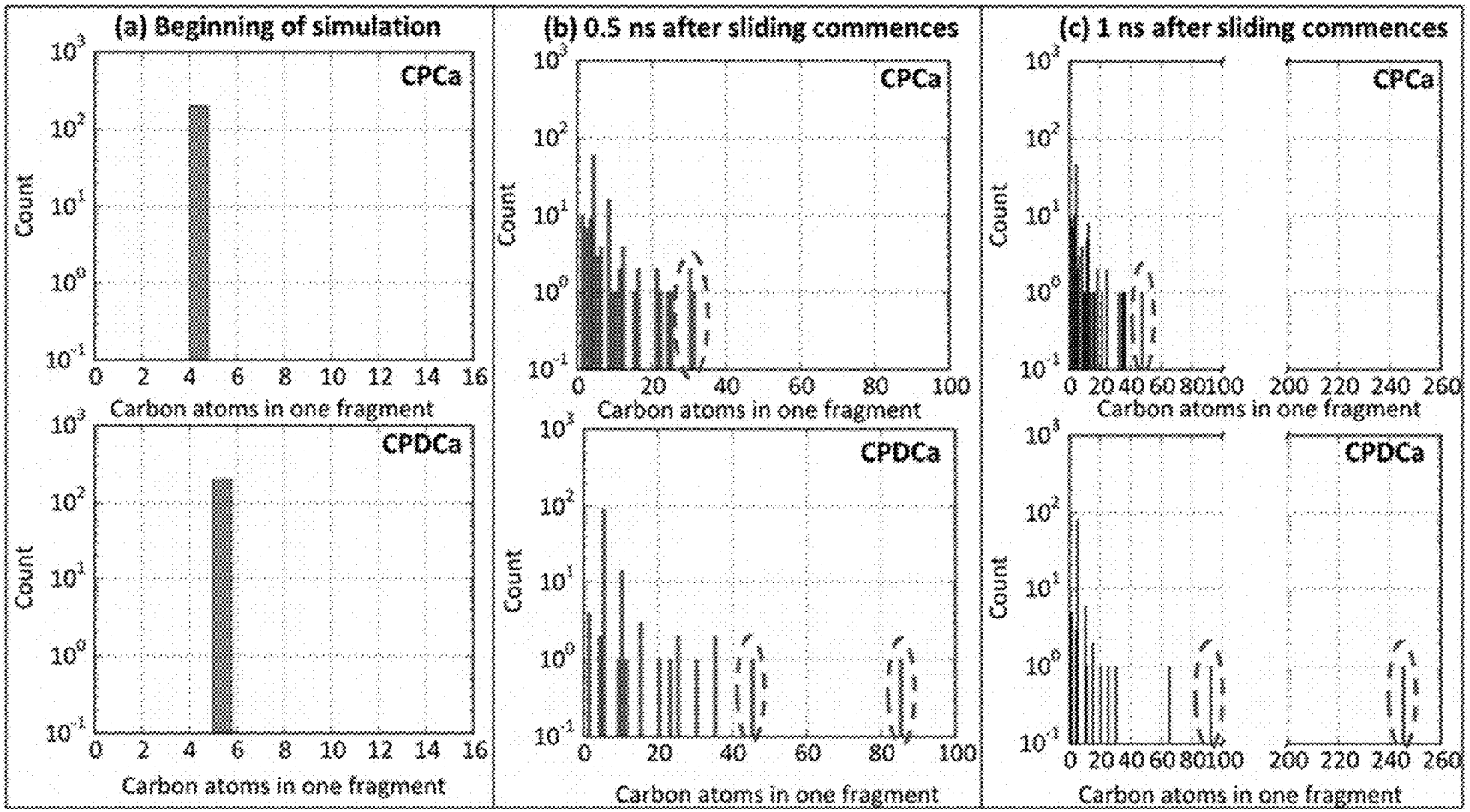
FIGS. 9A-9C show comparison of carbon fragment distributions obtained from CPCa and CPDCa during sliding.

In the third set of simulation studies, for further confirmation of the better polymerization ability of CPDCa, sliding simulations were conducted to compare the product formed from CPCa and CPDCa. For the analysis of the products formed during simulation, the number of carbon-containing fragments (C-fragments) was calculated with time. FIGS. 9A-9C compare the distribution of C-fragments obtained from CPCa and CPDCa at selected times. After 0.5 ns of the sliding phase, the two largest fragments formed from CPCa have carbon count of 30 and 31. On the other hand, CPDCa results in the formation of much larger fragments, i.e., carbon count of 45 and 85. At 1 ns after sliding commences, the two largest fragments from CPCa have carbon count of 36 and 47, while the corresponding ones from CPDCa are 92 and 245. Thus, the formation of the two largest fragments from the CPCa system consumes about 10% of the total number of carbon atoms (83 out of 800 carbons atoms), whereas CPDCa consumes about 33% (337 out of 1000 carbon atoms), demonstrating the improved polymerization for the latter.

CONCLUSIONS

CPCa was explored as a model additive to study tribopolymerization. In certain embodiments, the additive was modified in two ways: substituting cyclopropane with less strained cyclobutane and adding one carboxyl group to increase the adsorption strength. The major findings are as follows:

Replacing cyclopropane by cyclobutane increases friction and wear slightly. MD simulation shows slower dissociation kinetics of CBCa compared with CPCa. This is not unexpected given that cyclobutane is less strained and hence is more stable compared with cyclopropane.

Having two carboxyl groups increases the binding strength of adsorbate molecules (CPDCa) to the surface compared with CPCa, as demonstrated by the surface coverage of these adsorbates as a function of time at a given temperature.

The larger adsorption strength of CPDCa allows these molecules to remain on the surface long enough to facilitate dissociation induced mechanically or thermally and subsequent polymerization to yield tribopolymers. As a result, CPDCa results in the best friction and wear performance under our testing conditions.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference.

LIST OF REFERENCES

[1]. Holmberg, K., Erdemir, A.: The impact of tribology on energy use and CO2 emission globally and in combustion engine and electric cars. Tribology International 135:389-396 (2019).

[2]. Nosonovsky, M., Bhushan, B.: Green tribology: principles, research areas and challenges. Philos Trans A Math Phys Eng Sci 368:4677-4694 (2010).

[3]. Spikes, H.: Friction modifier additives. Tribology Letters 60 (2015).

[4]. Zhou, Y., Qu, J.: Ionic liquids as lubricant additives: a review. ACS Appl Mater Interfaces 9:3209-3222 (2017).

[5]. Hermance, H. W., Egan, T. F.: Organic deposits on precious metal contacts. The Bell System Technical Journal 37:739-776 (1958).

[6]. Fein, R. S., Kreuz, K. L.: Chemistry of boundary lubrication of steel by hydrocarbons. A S L E Transactions 8:29-38 (1965).

[7]. Furey, M. J., Kajdas, C., Ward, T. C., Hellgeth, J. W.: Thermal and catalytic effects on tribopolymerization as a new boundary lubrication mechanism. Wear 136:85-97 (1990).

[8]. Zheng, J., Zhang, L., Du, Z., Zhang, C., Li, H.: Tribopolymerization of n-butyl acrylate on the steel-steel rubbing surface. Tribology International 41:769-777 (2008).

[9]. Svahn, F., Csillag, S.: Formation of low-friction particle/polymer composite tribofilms by tribopolymerization. Tribology Letters 41:387-393 (2010).

[10]. Wang, Q. J., Chung, Y.-W.: Encyclopedia of Tribology (2013).

[11]. Khajeh, A., He, X., Yeon, J., Kim, S. H., Martini, A.: Mechanochemical association reaction of interfacial molecules driven by shear. Langmuir 34:5971-5977 (2018).

[12]. He, X., Kim, S. H.: Surface chemistry dependence of mechanochemical reaction of adsorbed molecules—an experimental study on tribopolymerization of alpha-pinene on metal, metal oxide, and carbon surfaces. Langmuir 34:2432-2440 (2018).

[13]. Yeon, J., He, X., Martini, A., Kim, S. H.: Mechanochemistry at solid surfaces: polymerization of adsorbed molecules by mechanical shear at tribological interfaces. ACS Appl Mater Interfaces 9:3142-3148 (2017).

[14]. Wu, H., Khan, A. M., Johnson, B., Sasikumar, K., Chung, Y. W., Wang, Q. J.: Formation and nature of carbon-containing tribofilms. ACS Appl Mater Interfaces 11:16139-16146 (2019).

[15]. Johnson, B., Wu, H., Desanker, M., Pickens, D., Chung, Y.-W., Jane Wang, Q.: Direct formation of lubricious and wear-protective carbon films from phosphorus- and sulfur-free oil-soluble additives. Tribology Letters 66 (2017).

[16]. Gosvami, N. N., Bares, J. A., Mangolini, F., Konicek, A. R., Yablon, D. G., Carpick, R. W.: Mechanisms of antiwear tribofilm growth revealed in situ by single-asperity sliding contacts. Science 348:102 (2015).

[17]. Adams, H., Miller, B. P., Furlong, O. J., Fantauzzi, M., Navarra, G., Rossi, A., Xu, Y., Kotvis, P. V., Tysoe, W. T.: Modeling mechanochemical reaction mechanisms. ACS Appl Mater Interfaces 9:26531-26538 (2017).

[18]. Jacobs, T. D. B., Gotsmann, B., Lantz, M. A., Carpick, R. W.: On the application of transition state theory to atomic-scale wear. Tribology Letters 39:257-271 (2010).

[19]. Jacobs, T. D., Carpick, R. W.: Nanoscale wear as a stress-assisted chemical reaction. Nat Nanotechnol 8:108-112 (2013).

[20]. Spikes, H., Tysoe, W.: On the commonality between theoretical models for fluid and solid friction, wear and tribochemistry. Tribology Letters 59 (2015).

[21]. Adams, H. L., Garvey, M. T., Ramasamy, U. S., Ye, Z., Martini, A., Tysoe, W. T.: Shear-induced mechanochemistry: pushing molecules around. The Journal of Physical Chemistry C 119:7115-7123 (2015).

[22]. He, Y., Zolper, T. J., Liu, P., Zhao, Y., He, X., Shen, X., Sun, H., Duan, Q., Wang, Q.: Elastohydrodynamic lubrication properties and friction behaviors of several ester base stocks. Friction 3:243-255 (2015).

[23]. Khan, A. M., Wu, H., Ma, Q., Chung, Y.-W., Wang, Q. J. Relating tribological performance and tribofilm formation to the adsorption strength of surface-active precursors. Tribology Letters 68 (2020).

[24]. Plimpton, S. Fast parallel algorithms for short-range molecular dynamics. Journal of Computational Physics 117:1-19 (1995).

[25]. van Duin, A. C. T., Dasgupta, S., Lorant, F., Goddard I I I, W. A. ReaxFF: A reactive force field for hydrocarbons. Journal of Materials Chemistry A 105:9396-9409 (2001).

[26]. Rahaman, O., van Duin, A. C. T., Goddard, W. A., Doren, D. J. Development of a reaxFF reactive force field for glycine and application to solvent effect and tautomerization. The Journal of Physical Chemistry B 115:249-261 (2011).

[27]. Stukowski, A. Visualization and analysis of atomistic simulation data with OVITO—the open visualization tool. Modelling and Simulation in Materials Science and Engineering 18:015012 (2009).

[28]. Fursey, A. Oxide films on mild steel. Nature 207:747-748 (1965).

[29]. Aryanpour, M., van Duin, A. C. T., Kubicki, J. D. Development of a reactive force field for iron-oxyhydroxide systems. The Journal of Physical Chemistry A 114: 6298-6307 (2010).

[30]. Lineira del Rio, J. M., Guimarey, M. J. G., Comuñas, M. J. P., Lopez, E. R., Amigo, A., Fernández, J. Thermophysical and tribological properties of dispersions based on graphene and a trimethylolpropane trioleate oil. Journal of Molecular Liquids 268:854-866 (2018).

[31]. Qiao, S., Shi, Y., Wang, X., Lin, Z., Jiang, Y. Synthesis of biolubricant trimethylolpropane trioleate and its lubricant base oil properties. Energy & Fuels 31:7185-7190 (2017).

[32]. Miranda, A. M., Castilho-Almeida, E. W., Martins Ferreira, E. H., Moreira, G. F., Achete, C. A., Armond, R. A. S. Z., et al. Line shape analysis of the Raman spectra from pure and mixed biofuels esters compounds. Fuel 115:118-125 (2014).

[33]. Schonemann, A., Edwards, H. G. Raman and FTIR microspectroscopic study of the alteration of Chinese tung oil and related drying oils during ageing. Anal Bioanal Chem 400:1173-1180 (2011).

What is claimed is:

1. A lubricant additive, comprising:

one or more surface-active groups attractable to a target surface; and a carbon containing component operable connected to the one or more surface active groups, wherein the carbon containing component comprises a carbon ring structure having a high ring strain that is metastable and activatable with a ring-opening reaction, wherein the one or more surface active groups comprise two or more carboxyl groups;

wherein the lubricant additive comprises cycloalkane-carboxylic acid molecules, wherein the cycloalkane-carboxylic acid molecules comprise cyclopropanecarboxylic acid (CPCa), cyclobutanecarboxylic acid (CBCa), cyclopropane-1,1-dicarboxylic acid (CPDCa), and cyclobutane-1,1-dicarboxylic acid (CBDCa), or a mixture thereof; and wherein a carbon film is operably formed in situ on the target surface only when tribological energy activates the lubricant additive to unravel the carbon containing component under a pressure and a temperature during operation.

2. The lubricant additive of claim 1, wherein the lubricant additive has a higher adsorption strength to allow molecules to remain on the target surface long enough to facilitate dissociation induced mechanically or thermally and subsequent polymerization to yield tribopolymers.

3. The lubricant additive of claim 1, wherein the lubricant additive operably binds to the target surface via polar (electrostatic) or chemical interactions through the surface active group.

4. The lubricant additive of claim 1, wherein increasing the number of the carboxyl groups results in stronger binding of the lubricant additive to the target surface, thereby increasing residence time and hence facilitating mechanically or thermally induced dissociation and subsequent polymerization.

5. A lubricant composition used for in situ forming a carbon film on a target surface of a target machine, comprising:

a base lubricant; and a plurality of lubricant additive molecules, wherein each lubricant additive molecule comprises:

one or more surface-active groups attractable to a target surface; and a carbon containing component operable connected to the one or more surface active groups, wherein the carbon containing component comprise a carbon ring structure having a high ring strain that is metastable and activatable with a ring-opening reaction, wherein the one or more surface active groups comprise two or more carboxyl groups;

wherein the plurality of lubricant additive molecules comprises cycloalkane-carboxylic acid molecules, wherein the cycloalkane-carboxylic acid molecules comprises cyclopropanecarboxylic acid (CPCa), cyclobutanecarboxylic acid (CBCa), cyclopropane-1,1-dicarboxylic acid (CPDCa), and cyclobutane-1,1-dicarboxylic acid (CBDCa), or a mixture thereof; and wherein the carbon film is formed on the target surface of the target machine only when tribological energy activates the lubricant additive to unravel the carbon containing component under a pressure and a temperature during operation.

6. The lubricant composition of claim 5, wherein the lubricant composition has about 0.5-10 wt. % of the lubricant additive molecules.

7. The lubricant composition of claim 6, wherein the lubricant composition has about 0.5 wt. % of the lubricant additive molecules.

8. The lubricant composition of claim 5, wherein the carbon film is oligomeric/polymeric in nature.

9. The lubricant composition of claim 5, wherein the lubricant additive has a higher adsorption strength to allow molecules to remain on the target surface long enough to facilitate dissociation induced mechanically or thermally and subsequent polymerization to yield tribopolymers.

10. The lubricant composition of claim 5, wherein the lubricant additive molecules operably bind to the target surface via polar (electrostatic) or chemical interactions through the one or more surface active groups.

11. The lubricant composition of claim 10, wherein the one or more surface active groups have positive charges, and the target surface has negative charges, and vice versa, such that the one or more surface active groups are attractable to the target surface.

12. The lubricant composition of claim 5, wherein the lubricant composition has Raman features at about 1350 and 1580 $cm^{-1}$.

13. A method for in situ forming a carbon film on a target surface of a target machine, comprising:

adding the lubricant composition of claim 5 into the target machine, wherein the lubricant composition is in contact with the target surface of the target machine; and operating the target machine to cause a temperature and a pressure at the target surface so that the carbon containing component is unraveled thereon to form a carbon film on the target surface during the operation.

14. The method of claim 13, wherein the lubricant composition has about 0.5-10 wt. % of the lubricant additive molecules.

15. The method of claim 13, wherein the temperature is in a range of 25° C.-500° C., and the pressure is in a range of 0.1-3 Gpa.

16. The method of claim 13, wherein the carbon film is oligomeric/polymeric in nature.

* * * * *